United States Patent [19]

Falensky

[11] 4,012,922

[45] Mar. 22, 1977

[54] AIR COOLING EQUIPMENT FOR COOLING CONTAINERS

[75] Inventor: Georg Falensky, Hamburg, Germany

[73] Assignee: Grünzweig & Hartmann und Glasfaser AG, Ludwigshafen, Germany

[22] Filed: Aug. 11, 1975

[21] Appl. No.: 603,890

[30] Foreign Application Priority Data

Nov. 29, 1974 Germany ..... 2456477

[52] U.S. Cl. ..... 62/240; 62/299; 62/302; 62/441; 98/115 VM; 114/72; 239/184; 239/566

[51] Int. Cl.[2] ..... B63B 25/26

[58] Field of Search ..... 239/184, 566; 62/240, 62/302, 298, 299, 419, 441; 98/115 VM; 114/72

[56] References Cited

UNITED STATES PATENTS

| | | | |
|---|---|---|---|
| 3,225,822 | 12/1965 | Westling | 62/240 X |
| 3,440,834 | 4/1969 | Hirai et al. | 62/240 |
| 3,477,243 | 11/1969 | Schroeder et al. | 62/298 |
| 3,879,957 | 4/1975 | Wilson et al. | 62/240 |

*Primary Examiner*—Ronald C. Capossela
*Attorney, Agent, or Firm*—John C. Smith, Jr.

[57] ABSTRACT

An air cooling equipment for cooling containers stacked in ships' holds comprises an upright column attached to a bulkhead or some other part of the ship's structure and provided with connections adapted to cooperate with corresponding connections provided on the containers in the stack for the supply of cold air and the withdrawal of exhaust air. The column is mounted in a manner which permits its horizontal displacement towards and away from the stack of containers. Each column connection is provided with a sealing ring which can be pressed on the cooperating connection of a container to create a tight seal.

6 Claims, 5 Drawing Figures

AIR COOLING EQUIPMENT FOR COOLING CONTAINERS

BACKGROUND OF THE INVENTION

This invention relates to air cooling equipment for cooling containers stacked in ships' holds comprising an upright column attached to a bulkhead or some other part of the ship's structure and provided with connections adapted to cooperate with corresponding connections provided on the containers in the stack for the supply of cold air and the withdrawal of exhaust air.

Fixed air cooling equipment of this kind for ships is already known. It serves to blow cold air into containers stacked in the ship's holds. When the cooling containers have been loaded, flexible couplings are used to establish airtight connections between the containers and the air cooling equipment. These couplings are held in position by air pressure and they are released from the container by exhausting the air. Alternatively they may be pressed against the containers by spring means and released from the container by opening a lock by compressed air. For this purpose each connection needs two air supply pipes. The high speed techniques at container terminals for unloading containers frequently result in couplings being torn because they had inadvertently not been released in time before the containers were lifted out. Lack of time prevents suitable checks being made since the couplings are all remote controlled. Remote monitoring is expensive and in the rough conditions obtaining at container terminals such systems would be most vulnerable. The couplings themselves are expensive both to provide and install. Defective couplings which do not satisfactorily seal cause perishable cargoes in the containers to spoil.

SUMMARY OF THE INVENTION

It is the object of the present invention to eliminate these defects and to reduce the number of fittings needed for control as well as the number of flexible air pipes, to facilitate supervision and to improve the safety of the cooling system.

This object is achieved by the present invention which consists in mounting the column in a manner permitting its horizontal displacement towards and away from the stack of containers and in providing each column connection with a sealing ring which can be pressed on the cooperating connection of a container to create a tight seal.

The required displacement of the column may be effected by driven feed screws or by actuator cylinders operated by a pressure fluid and interposed between the column and a bulkhead. Elastically yielding members may be provided between the drive means and the column.

BRIEF DESCRIPTION OF THE DRAWING

In order that the invention may be more readily understood an embodiment thereof, purely by way of example, will now be described and reference made to the accompanying drawing, in which.

DESCRIPTION OF THE PREFERRED EMBODIMENTS

Figure 1:
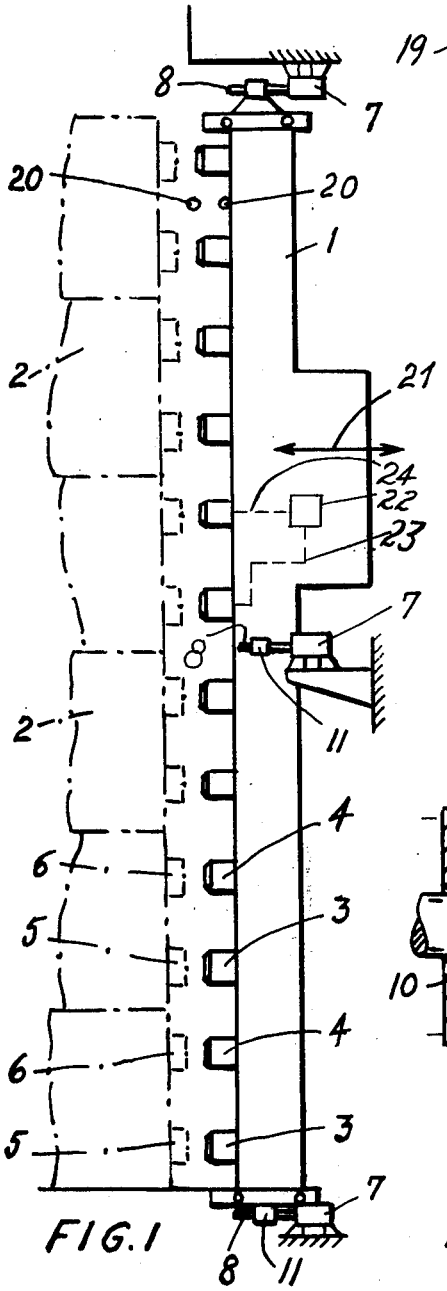
FIG. 1 is a side elevation of a column which serves as an air-cooling device.

In conventional manner equipment in the form of a column 1 for cooling cargo in containers 2 contains an air cooler 22 including a blower and ducts 23, 24 for the supply and withdrawal of air. These items are not shown in the drawing. The air ducts are provided with connecting mouthpieces 3 for the supply of cold air and connecting mouthpieces 4 for the withdrawal of exhaust air. These mouthpieces cooperate with corresponding connecting fittings 5 and 6 on the air-cooled containers.

For the purpose of reliably, quickly and simultaneously making the necessary connections with the stacked containers that are to be air cooled, the column 1 is movably mounted and adapted to be advanced and retracted (see double arrow 21 in FIG. 1) for simultaneously establishing and breaking the coupling connections between all its mouthpieces and the corresponding connection fittings on the containers.

Figure 3:
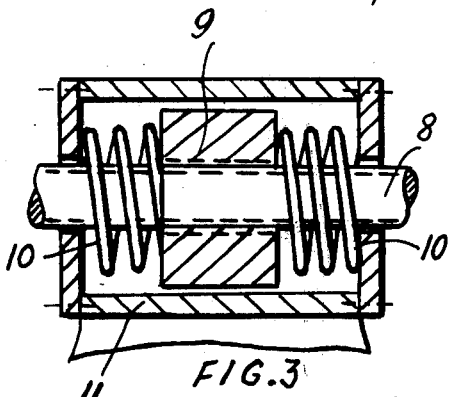
FIG. 3 is a feed screw for advancing and retracting the column.

In the arrangement illustrated in FIG. 3 the column can be displaced by a feed screw 8 driven by an electric motor 7 and a captive self-locking nut 9. The term self-locking is understood to relate to a nut which has threads pitched at an angle within the limiting angle of friction. Displacement of the nut 9 by the feed screw 9 is effected against the resistance of opposed acting springs 10 accommodated in a cage 11. The springs provide a yielding transmission of thrust from the nut to the column, the cage 11 being fixed to the column 1.

Figure 5:
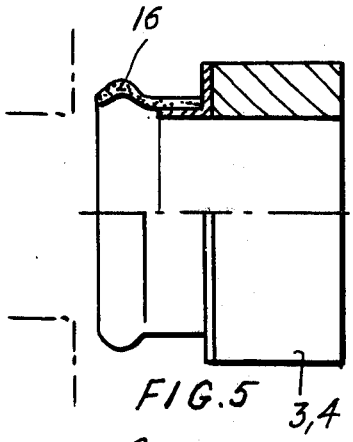
FIG. 5 is a flexible ring which seals a connecting joint between container and column.
Figure 4:
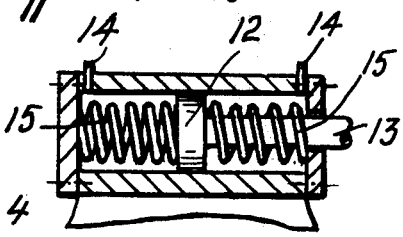
FIG. 4 is a similar arrangement for operation by a pressure fluid.

FIG. 4 illustrates an alternative embodiment in which the column 1 is displaceable by a ram piston 12 operable by a pressure fluid. The piston rod 13 is affixed to the piston 12 which is displaceable by the admission and withdrawal of a pressure fluid through connections 14 against the resistance of opposed acting springs 15 likewise acting as yielding transmission members between piston and column 1. As shown in FIG. 5 the mouthpieces 3 and 4 on the column 1 are provided with flexible sealing rings 16 which are tightly pressed against the faces of the connecting fittings 5 and 6 of the containers 2 when the column 1 is advanced.

Figure 2:
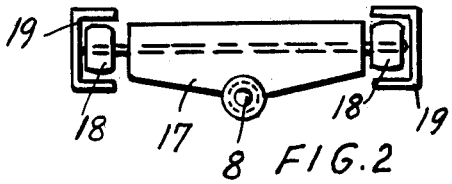
FIG. 2 is the arrangement for movably mounting the column.

FIG. 2 represents a cross member 17 which is affixed to the column 1. This cross member carries rollers 18 which are arranged to run in rails 19 and thereby facilitate the displacement of the column 1. Cross members 17 of this kind may be fitted at the top and bottom of the column and additional cross members 17 may be provided intermediately along the height of the column.

In an electric drive the end positions of the column 1 are determined by limit switches 20 (FIG. 1). When operated by actuator cylinders the same effect can be achieved by fitting spill valves.

The invention may be embodied in other specific forms without departing from the spirit or essential characteristics thereof. The embodiments are therefore to be considered in all respects as illustrative and not restrictive.

What I claim is:

1. An air-cooling arrangement for cooling a single stack of containers in a hold of a ship wherein each container includes at least two connecting fittings on one side thereof to permit entry of cooling air and exit of exhaust air, said arrangement comprising:

a. a vertically disposed column, b. means mounting said column for movement along a horizontal path, c. a plurality of connecting mouthpieces fixedly arranged along and projecting from one side of said column, each of said mouthpieces including a flexible sealing ring for pressing against a connecting fitting of a container to create a tight seal, d. a plurality of ducts arranged within said column for directing cooling air and exhaust air through respective of said connecting mouthpieces, and e. means for displacing said column towards and away from a single stack of containers along said horizontal path, f. whereby said mouthpieces may simultaneously be pressed against all of said connecting fittings of all of said containers in a stack to circulate cooling air through said containers when said column is moved towards said stack and disconnected from said fittings when said column is moved away from said stack.

2. An air-cooling arrangement as defined in claim 1 further comprising resilient biasing means interposed between said column and said displacing means whereby said column may be biased in the direction of said stack to maintain said sealing rings pressed against said connecting fittings on said containers.

3. An air-cooling arrangement as defined in claim 1 wherein said displacing means comprises at least one captive nut, a feed screw passing through said captive nut and drive means.

4. An air-cooling arrangement as defined in claim 3 further comprising a pair of spring members on opposite sides of said captive nut and means for retaining said spring members whereby said column may be biased in the direction of said stack to maintain said sealing rings pressed against said connecting fittings on said containers.

5. An air-cooling arrangement as defined in claim 1 wherein said displacing means comprises at least one cylinder and a piston contained within said cylinder operable by pressure fluid.

6. An air-cooling arrangement as defined in claim 5 further comprising a pair of spring members on opposite sides of said piston whereby said column may be biased in the direction of said stack to maintain said sealing rings pressed against said connecting fittings on said containers.

* * * * *